US008512844B2

(12) United States Patent
Dijkema et al.

(10) Patent No.: US 8,512,844 B2
(45) **Date of Patent: *Aug. 20, 2013**

(54) BONDED AND TUFTED NONWOVENS II, METHODS FOR THEIR MANUFACTURE AND USES

(75) Inventors: Jan Dijkema, Zutphen (NL); Edze Jan Visscher, Utrecht (NL)

(73) Assignee: Bonar B.V., Arnhem (NL)

( * ) Notice: Subject to any disclaimer, the term of this patent is extended or adjusted under 35 U.S.C. 154(b) by 570 days.

This patent is subject to a terminal disclaimer.

(21) Appl. No.: 12/308,177

(22) PCT Filed: Jul. 10, 2007

(86) PCT No.: PCT/EP2007/006092

§ 371 (c)(1),
(2), (4) Date: Dec. 9, 2008

(87) PCT Pub. No.: WO2008/009370

PCT Pub. Date: Jan. 24, 2008

(65) Prior Publication Data

US 2009/0304953 A1 Dec. 10, 2009

(30) Foreign Application Priority Data

Jul. 15, 2006 (EP) ..... 06014783

(51) Int. Cl.

| | |
|---|---|
| ***D05C 17/02*** | (2006.01) |
| ***D05C 15/04*** | (2006.01) |
| ***D04H 3/08*** | (2006.01) |
| ***D04H 3/14*** | (2012.01) |

(52) U.S. Cl.
USPC ..... 428/95; 428/96; 156/72; 156/180; 156/181

(58) Field of Classification Search
USPC ..... 428/95, 96; 156/72, 166, 180, 181; 264/103, 171.1, 172.13, 172.14, 172.15; 442/361, 362, 363, 364; 210/500.1, 503, 210/505
See application file for complete search history.

(56) References Cited

U.S. PATENT DOCUMENTS

| | | | | |
|---|---|---|---|---|
| 3,940,302 | A * | 2/1976 | Matthews et al. | 156/167 |
| 4,210,690 | A | 7/1980 | Hartmann et al. | |
| 4,578,132 | A * | 3/1986 | Van Uden et al. | 156/72 |
| 4,842,915 | A * | 6/1989 | Hartmann et al. | 428/95 |
| 5,660,910 | A | 8/1997 | Hoyt et al. | |
| 5,851,355 | A | 12/1998 | Goettmann | |
| 6,103,181 | A | 8/2000 | Berger | |
| 6,330,883 | B1 | 12/2001 | Berger | |
| 6,576,034 | B2 | 6/2003 | Berger | |
| 6,582,639 | B2 | 6/2003 | Nellis | |
| 6,596,049 | B1 | 7/2003 | Berger | |
| 6,602,311 | B2 | 8/2003 | Berger | |
| 6,616,723 | B2 | 9/2003 | Berger | |
| 6,833,104 | B2 | 12/2004 | Berger | |
| 7,179,412 | B1 | 2/2007 | Wilkie et al. | |
| 7,192,550 | B2 | 3/2007 | Berger et al. | |
| 7,695,794 | B2 | 4/2010 | Oosterbroek et al. | |
| 7,892,622 | B2 * | 2/2011 | Locher et al. | 428/95 |
| 2002/0116910 | A1 | 8/2002 | Berger | |
| 2002/0134063 | A1 | 9/2002 | Berger | |
| 2002/0139099 | A1 | 10/2002 | Berger | |
| 2002/0144490 | A1 | 10/2002 | Berger | |
| 2003/0196421 | A1 | 10/2003 | Berger | |
| 2004/0142142 | A1 * | 7/2004 | Gardner et al. | 428/95 |
| 2005/0142325 | A1 | 6/2005 | Veurink et al. | |
| 2005/0159064 | A1 | 7/2005 | Rowell et al. | |
| 2005/0186290 | A1 | 8/2005 | Cals-Grierson | |
| 2005/0249911 | A1 * | 11/2005 | Randall et al. | 428/85 |
| 2006/0057328 | A1 * | 3/2006 | Pacione et al. | 428/95 |
| 2008/0017294 | A1 * | 1/2008 | Bailey et al. | 156/72 |

(Continued)

FOREIGN PATENT DOCUMENTS

| | | |
|---|---|---|
| DE | 36 42 089 A1 | 6/1988 |
| JP | A 5-177634 | 7/1993 |

(Continued)

OTHER PUBLICATIONS

International Search Report issued in International Patent Application No. PCT/EP2007/003843 mailed Sep. 6, 2007.

Office Action mailed Nov. 12, 2010 in related pending U.S. Appl. No. 12/226,562.

(Continued)

*Primary Examiner* — Cheryl Juska
(74) *Attorney, Agent, or Firm* — Oliff & Berridge, PLC

(57) ABSTRACT

A tufted nonwoven with improved stitch holding, a bonded nonwoven and methods for their manufacture are described. The tufted nonwoven with improved stitch holding comprises a face material which tufts a bonded nonwoven comprising a mixture of a plurality of bicomponent filaments 1 with a plurality of bicomponent filaments 2 wherein iα) at least bicomponent filaments 1 exhibit a core/sheath geometry wherein component 11 represents the core and component 12 represents the sheath or iβ) at least bicomponent filaments 1 exhibit a side by side geometry wherein component 11 represents side 1 and component 12 represents side 2 or iγ) at least bicomponent filaments 1 exhibit an islands in the sea geometry wherein component 11 represents the islands and component 12 represents the sea ii) the component 11 exhibits a melting temperature $T_m(11)$ and the component 22 exhibits a melting temperature $T_m(22)$, iii) the component 12 exhibits a melting temperature $T_m(12)$, the component 21 exhibits a melting temperature $T_m(21)$ and $T_m(12)$ is higher than $T_m(21)$ and iv) the melting temperatures of both component 11 and 22 and the melting temperatures of components 12 and 21 obey to the relation both $T_m(11)$ and $T_m(22)>T_m(12)>T_m(21)$ an wherein the face material is bonded to bicomponent filaments 1 and 2 by a solidified melt of components 12 and 21.

23 Claims, No Drawings

(56) References Cited

U.S. PATENT DOCUMENTS

| | | | |
|---|---|---|---|
| 2008/0116129 | A1 | 5/2008 | Oosterbroek et al. |
| 2009/0152191 | A1 | 6/2009 | Dijkema et al. |
| 2009/0304953 | A1 | 12/2009 | Dijkema et al. |

FOREIGN PATENT DOCUMENTS

| | | | | |
|---|---|---|---|---|
| JP | 10266057 | A | * | 10/1998 |
| JP | A-11-309063 | | | 11/1999 |
| WO | WO 00/12800 | | | 3/2000 |
| WO | WO 03/069039 | A1 | | 8/2003 |
| WO | WO 2006/079511 | | | 8/2006 |

OTHER PUBLICATIONS

U.S. Appl. No. 12/226,562, filed Oct. 22, 2008.
Notice of Allowance mailed Feb. 8, 2010 in U.S. Appl. No. 11/794,128.
International Search Report issued in International Patent Application No. PCT/EP2006/000629 mailed Jun. 7, 2006.
Dr. R. Krčma, Chapter 10.1 of the "Manual of Nonwovens" (1971), Textile Trade Press, Manchester, England, pp. 202-231.
Oct. 15, 2009 Office Action from U.S. Appl. No. 11/794,128.
Japanese Office Action issued May 23, 2012 in Japanese Patent Application No. 2009-519826.

* cited by examiner

BONDED AND TUFTED NONWOVENS II, METHODS FOR THEIR MANUFACTURE AND USES

The present invention pertains to a tufted nonwoven, a bonded nonwoven, methods for their manufacture and uses thereof.

WO 00/12800 discloses a nonwoven primary carpet backing comprising thermoplastic polymer filaments or fibers bonded by means of a binder polymer, wherein the backing comprises at least a distinguishable thermoplastic woven layer, a distinguishable thermoplastic continuous layer, or a distinguishable nonwoven layer also comprising filaments or fibers bonded by means of a binder polymer. If said primary carpet backing is tufted an increased stitch lock (stitch holding) is observed however in combination with a reduced delamination strength of the backing.

US 2002/0144490 discloses a fiber spinning process for manufacturing a web of fibers comprising a homogeneous mixture of fibers of different characteristics. Bicomponent fibers having a common core polymer and different sheath polymers can be extruded from alternate spinneret orifices in the same die plate. Products formed from the improved mixed fiber technology are useful as high efficiency filters in various environments, coalescent filters, reservoirs for marking and writing instruments, wicks and other elements designed to hold and transfer liquids for medical and other applications, heat and moisture exchangers and other diverse fibrous matrices.

Therefore, one object of the present invention is to provide a method to manufacture a nonwoven which after tufting yields a tufted nonwoven exhibiting an increased stitch holding without reduced delamination strength.

Said object is achieved by a method to manufacture a tufted nonwoven with improved stitch holding comprising the following steps:

a) Mixing a plurality of bicomponent filaments 1 which comprise a component 11 and a component 12 with a plurality of bicomponent filaments 2 which comprise a component 21 and a component 22 wherein
   - iα) at least bicomponent filaments 1 exhibit a core/sheath geometry wherein component 11 represents the core and component 12 represents the sheath or
   - iβ) at least bicomponent filaments 1 exhibit a side by side geometry wherein component 11 represents side 1 and component 12 represents side 2 or
   - iγ) at least bicomponent filaments 1 exhibit an islands in the sea geometry wherein component 11 represents the islands and component 12 represents the sea
   - ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$,
   - iii) the component 12 exhibits a melting temperature $T_m(12)$, the component 21 exhibits a melting temperature $T_m(21)$ and $T_m(12)$ is higher than $T_m(21)$ and
   - iv) the melting temperatures of both component 11 and 22 and the melting temperatures of components 12 and 21 obey to the relation both $T_m(11)$ and $T_m(22)>T_m(12)>T_m(21)$ and producing a basic fibrous layer in a method known per se in which bicomponent filaments 1 contact bicomponent filaments 2 at zones of overlap, b) heating the basic fibrous layer at a temperature for nonwoven production $T_{np}$ which obeys to the relation $T_m(12)>T_{np}>T_m(21)$ till component 21 melts at the zones of overlap and then cooling below $T_m(21)$ resulting in a bonded nonwoven, c) tufting the bonded nonwoven with a face material resulting in a tufted nonwoven, exhibiting contacts between the face material and bicomponent filaments 1 and 2 and optionally d) heating the tufted nonwoven, optionally under pressure, at a temperature $T_m$ which obeys to the relation $T_m(12)<T_m<T_m(11)$ and $T_m(22)$ till component 12 and component 21 melt resulting in a tufted nonwoven in which molten component 21 and molten component 12 contact the face material and then cooling the nonwoven below $T_m(21)$, to obtain the tufted nonwoven with improved stitch holding.

According to step a)iα) at least the bicomponent filaments 1 exhibit a core/sheath geometry wherein component 11 represents the core and component 12 represents the sheath. Within the scope of the present invention this means that either bicomponent filaments 1 and bicomponent filaments 2 exhibit core/sheath geometry or bicomponent filaments 1 exhibit core/sheath geometry and bicomponent filaments 2 exhibit another bicomponent geometry, e.g. a side by side geometry or an island in the sea geometry. Consequently, if bicomponent filaments 1 and bicomponent filaments 2 exhibit a core/sheath geometry component 11 represents the core of bicomponent filaments 1, component 12 represents the sheath of bicomponent filaments 1, component 22 represents the core of bicomponent filaments 2 and component 21 represents the sheath of bicomponent filament 2. However, if bicomponent filaments 1 exhibit core/sheath geometry and bicomponent filaments 2 exhibit another bicomponent geometry e.g. a side by side geometry component 11 represents the core of bicomponent filaments 1, component 12 represents the sheath of bicomponent filaments 1, component 22 means side 1 of bicomponent filaments 2 and component 21 means side 2 of bicomponent filaments 2.

According to step a)iβ) at least the bicomponent filaments 1 exhibit a side by side geometry wherein component 11 represents side 1 and component 12 represents side 2. Within the scope of the present invention this means that either bicomponent filaments 1 and bicomponent filaments 2 exhibit side by side geometry or bicomponent filaments 1 exhibit side by side geometry and bicomponent filaments 2 exhibit another bicomponent geometry, e.g. a core/sheath geometry or an island in the sea geometry. Consequently, if bicomponent filaments 1 and bicomponent filaments 2 exhibit a side by side geometry component 11 represents the side 1 of bicomponent filaments 1, component 12 represents side 2 of bicomponent filaments 1, component 22 represents the side 1 of bicomponent filaments 2 and component 21 represents side 2 of bicomponent filaments 2. However, if bicomponent filaments 1 exhibit side by side geometry and bicomponent filaments 2 exhibit another bicomponent geometry e.g. a core/sheath geometry component 11 represents side 1 of bicomponent filaments 1, component 12 represents side 2 of bicomponent filaments 1, component 22 means the core of bicomponent filaments 2 and component 21 means the sheath of bicomponent filaments 2.

According to step a)iγ) at least the bicomponent filaments 1 exhibit an islands in the sea geometry wherein component 11 represents the islands and component 12 represents the sea. Within the scope of the present invention this means that either bicomponent filaments 1 and bicomponent filaments 2 exhibit an island in the sea geometry or bicomponent filaments 1 exhibit an island in the sea geometry and bicomponent filaments 2 exhibit another bicomponent geometry, e.g. a core/sheath geometry or a side by side geometry. Consequently, if bicomponent filaments 1 and bicomponent filaments 2 exhibit an islands in the sea geometry component 11 represents the islands of bicomponent filaments 1, component 12 represents the sea of bicomponent filaments 1, component 22 represents the islands of bicomponent filaments 2 and component 21 represents the sea of bicomponent filaments 2. However, if bicomponent filaments 1 exhibit an islands in the sea geometry and bicomponent filaments 2 exhibit another bicomponent geometry e.g. a core/sheath geometry component 11 represents the islands of bicomponent filaments 1, component 12 represents the sea of bicomponent filaments 1, component 22 means the core of bicomponent filaments 2 and component 21 means the sheath of bicomponent filaments 2.

The proportion of components 11:12 and of components 22:21 may be in the range of 5:95 to 95:5 vol.-% and preferably between 60:40 and 95:5 vol.-%. The ratio of bicomponent filaments 1 to bicomponent filaments 2 may be in the range of 5:95 to 95:5 wt.-% and is preferably 60:40 wt.-%.

For the sake of conciseness the advantageous properties of the tufted nonwoven obtained by the process of the present invention shall be explained in the following in an embodiment according to a)iα) wherein both bicomponent filaments 1 and 2 exhibit a core/sheath geometry. In this case the relation of temperatures in step iii) reads $T_m$(sheath 1)>$T_m$(sheath 2) and in step iv) reads both $T_m$(core 1) and $T_m$(core 2)>$T_m$(sheath 1)>$T_m$(sheath 2).

The tufted nonwoven obtained by the method of the present invention exhibits excellent stitch holding because in step d) at the contacts of the face material with the melt of sheath 1 and with the melt of sheath 2 of the bicomponent filaments 1 and 2 said melts start to flow along and/or around the face material thereby increasing the contact area between the face material and bicomponent filaments 1 and 2. By cooling below $T_m$(sheath 2), preferably below the glass transition temperature of sheath 2 $T_g$(sheath 2) in step d) said enlarged contact area solidifies and yields a strong adhesion between the face material and the sheaths of bicomponent filaments 1 and 2. Within the scope of the method according to the present invention heating at $T_m$ till the sheaths of bicomponent filaments 1 and 2 melt means that at the contacts of the face material with melts of sheath 1 and sheath 2 such a quantity of the sheaths of bicomponent filaments 1 and 2 melt that after cooling below $T_m$(sheath 2), preferably below the glass transition temperature of sheath 2 $T_g$(sheath 2) the resulting adhesion between the face material and the sheath of bicomponent filaments 1 and 2 is sufficiently strong for the intended uses of the tufted nonwoven described later. If the time, during which $T_m$ is applied to the tufted nonwoven, is sufficient to enable that the melts of sheath 1 and 2 can flow completely around the face material, after cooling below $T_m$(sheath 2), preferably below the glass transition temperature of sheath 2 $T_g$(sheath 2) loops of solidified sheath 1 and sheath 2 polymer tightly enclose the face material and thereby increase the stitch holding.

Furthermore, a tufted nonwoven results from the method according to the present invention without any problems with respect to delamination because the nonwoven obtained by said method is not a laminate.

Finally, the method of the present invention yields a tufted nonwoven with kept structural integrity because of the following reasons. In step b) the mixture of the bicomponent filaments 1 and 2 is heated at $T_m$(sheath 1)>$T_{np}$>$T_m$(sheath 2) till sheath 2 of bicomponent filaments 2 melts at the zones of overlap. In these zones of overlap of filaments skin bonding will occur thus providing structural integrity of the nonwoven.

One skilled in the art who knows the process of the present invention and the above explanation of the advantageous properties of the tufted nonwoven which results from said process is able to adapt this explanation to bicomponent embodiments e.g. with island in the sea geometry or with side by side geometry or with another bicomponent geometry. All such embodiments belong to the scope of the process of the present invention.

Although within the scope of the present invention the term "filament" in its broadest sense, including mono- or multifilaments which might be spun bond or melt blown or made by another technique known per se, is used, for those skilled in the art it is clear and will not depart from the scope of this invention that also shorter fibers, such as e.g. staple fibers, can be used instead. The usage of the term "filament" is for sake of convenience only and should not be considered a restriction in terms of the length of the fibers. The materials which can be used to form the bicomponent filaments 1 and 2 can be selected from a great variety of material classes provided that the melting points of the chosen classes obey to the restrictions which are taught in the process of the present invention. For example filaments of synthetic or natural origin comprising organic polymers can be used belonging e.g. to the groups of thermoplastics, elastomers or thermoplastic elastomers. Said filaments might be biodegradable. Furthermore, filaments comprising inorganic materials, e.g. ceramics, glasses or metals can be used. In the method of the present invention polymers and especially thermoplastic polymers are the preferred materials to be used for the bicomponent filaments 1 and 2.

Within the scope of the present invention the term "face material" means any material suitable for tufting provided that said material virtually does not melt or decompose at $T_m$(sheath 1). That means that the melting temperature of the face material or in the case of a face material which does not exhibit a melting point the decomposition temperature is higher than $T_m$(sheath 1). The face material can be used in the shape of ribbons, yarns, cord, artificial turf or in any other shape suitable for tufting.

Again, for the sake of conciseness the preferred embodiments of the process according to the present invention shall be explained in the following in an embodiment according to a)iα) wherein both bicomponent filaments 1 and 2 exhibit a core/sheath geometry. In this case as explained before the relation of temperatures in step iii) reads $T_m$(sheath 1)>$T_m$(sheath 2) and in step iv) reads both $T_m$(core 1) and $T_m$(core 2)>$T_m$(sheath 1)>$T_m$(sheath 2).

So, the selection of a polymer which forms the core of bicomponent filaments 1 and 2 is limited by the core's melting point in relation to the melting points of sheath 1 and 2 as defined in step 1a)iv) and of course by the properties which are required for the core of a polymeric bicomponent filament to be usable for the manufacture of a tufted nonwoven. Those skilled in the art know said required properties, e.g. strength, elongation, modulus, tuftability, molding behavior, dimensional stability etc.

So, correspondingly selected polymers can be used as core for the bicomponent filaments of the present invention's method. For example the same type of polymer can be used for the core of bicomponent filaments 1 and 2 wherein the melting point of the cores in bicomponent filaments 1 and 2 are equal or not equal the latter embodiment being realized e.g. by two polymers of the same type but with different molecular weights. Or two different types of polymers can be used for the cores of bicomponent filaments 1 and 2 having the same or a different melting point. In each of said embodiments 100 weight % of the core e.g. of bicomponent filaments 1 can consist of one certain core polymer. But it is also possible that a polymer material is selected for the core of bicomponent filaments 1 and/or 2 comprising an amount of <100 weight % of the core of the corresponding bicomponent filaments, the difference to 100 weight % comprising e.g. spinning auxiliaries, fillers, flame retardant materials, UV inhibitors, crystallizers, plastisizers, retarders/accelerators, heat stabilizers, antimicrobial additives or combinations thereof.

However, said <100 weight % amount of core polymer amount must be high enough to ensure that the core properties which are required for the process of the present invention are realized.

In a preferred embodiment of the process according to the present invention bicomponent filaments 1 exhibit a core/sheath geometry wherein component 11 represents the core and component 12 represents the sheath, wherein bicomponent filaments 2 exhibit a core/sheath geometry wherein component 22 represents the core and component 21 represents the sheath and wherein the cores of bicomponent filaments 1 and of bicomponent filaments 2 comprise a thermoplastic polymer selected from the group consisting of polyethyleneterephthalate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

In the method of the present invention the selection of the sheath polymer for bicomponent filaments 1 is limited by the melting point of the sheath of bicomponent filaments 1 in relation to the melting point of the sheath of bicomponent filaments 2 and of the cores as defined in step a)iv) and of course by the meltability of the sheaths of bicomponent filaments 1 and 2 without substantial degradation, i.e. without a substantial decrease of the properties of the sheath of bicomponent filaments 1 and 2 which are required for polymeric bicomponent filaments to be suited for the manufacture of a tufted nonwoven. Those skilled in the art know said required properties, e.g. strength, elongation, modulus, dye ability, coating behavior, hydrophilic/lipophilic balance, lamination behavior, fusion behavior and bonding strength. And said required properties have to be sufficiently retained in the bonded skins obtained in step b) and after the cooling in step d).

So, correspondingly selected thermoplastic polymers can be used as the sheath for the bicomponent filaments 1 and 2 of the present invention's method. For example the same type of polymer can be used for the sheaths of bicomponent filaments 1 and 2 wherein the melting points of the sheaths are different, e.g. because of different molecular weights. Or different types of polymers can be used for the sheaths of bicomponent filaments 1 and 2 wherein the melting points of the sheaths are different. In each of said embodiments the sheath of bicomponent filaments 1 and/or 2 can consist to 100 weight % of a certain thermoplastic polymer. But it is also possible that a selected polymer material for the sheath of bicomponent filaments 1 and/or 2 comprises <100 weight % of a thermoplastic polymer, the difference to 100 weight % comprising e.g. spinning auxiliaries, fillers, colorants, crystallizers, retarders/accelerators, stabilizers and plastisizers or combinations thereof. However, said <100 weight % amount of sheath polymer amount must be high enough to ensure that the sheath properties which are required for the process of the present invention are realized.

Preferably, the sheath of bicomponent filaments 1 comprises a thermoplastic polymer selected from the group consisting of polyamide (PA), e.g. PA 6, polypropylene (PP), polyethylene (PE) or copolymers thereof, polybutyleneterephthalate (PBT), polylactic acid (PLA) and aliphatic polyesters.

Preferably, the sheath of bicomponent filaments 2 comprises a thermoplastic polymer selected from the group consisting of polypropylene (PP), polyethylene (PE) or copolymers thereof, polylactic acid (PLA), polyvinylchloride (PVC).

The selection of a plurality of bicomponent filaments 1 and 2 for the mixing operation in step a) of the method according to the invention results in a combination of bicomponent filaments 1 and 2 wherein according to iii) $T_m$(sheath 1) is higher than $T_m$(sheath 2). Preferably $T_m$(sheath 1) is at least 5° C. and most preferably at least 50° C. higher than $T_m$(sheath 2).

Furthermore, the selection of a plurality of bicomponent filaments 1 and 2 for the mixing operation in step a) of the method according to the invention results in a combination of bicomponent filaments wherein according to iv) both $T_m$(core 1) and $T_m$(core 2) are higher than $T_m$(sheath 1). Preferably both $T_m$(core 1) and $T_m$(core 2) are at least 20° C. higher than $T_m$(sheath 1).

In a preferred embodiment of the method of the present invention bicomponent filaments 1 comprise a core of polyethylenterephthalate with $T_m$(core)=250° C. and a sheath of polyamide 6 with $T_m$(sheath 1)=220° C.

In an especially preferred embodiment of the method of the present invention bicomponent filaments 1 comprise a core of polyethyleneterephthalate with $T_m$(core)=250° C. and a sheath of polyamide 6 with $T_m$(sheath 1)=220° C. and bicomponent filaments 2 comprises a core of polyethyleneterephthalate with $T_m$(core)=250° C. and a sheath of polypropylene with $T_m$(sheath 2)=160° C.

According to step c) a face material is applied for tufting the bonded nonwoven. Preferably the face material to be used in step c) of the method of the invention is selected from the group consisting of polyamide (PA), polypropylene (PP), polylactic acid (PLA), wool and cotton provided that the melting temperature of said polymers and the decomposition temperature of said wool and cotton is higher than $T_m$(sheath 1).

The mixing of a plurality of bicomponent filaments 1 and a plurality of bicomponent filaments 2 in step a) of the method according to the invention can be performed by any of the methods known to those skilled in the art provided that the chosen method of mixing renders a sufficiently homogenous mixture of bicomponent filaments 1 and 2. Within the scope of the present invention the term "homogenous mixture" means that in every given volume element of the basic fibrous layer resulting from step a) of the method according to the invention about the same ratio of bicomponent filaments 1 and 2 is realized.

Preferably the mixing in step a) is performed by assembling or by mixing at a creel or by spinning from 3-component spin packs.

The production of the basic fibrous layer, also called web, may be performed with any of the technologies known for said purpose e.g. with mechanical, pneumatic or wet processing or with electrostatic systems or by using a polymer to web process or with the aid of filament entanglements or with split film methods. Examples for said technologies are e.g. given in chapter 10.1 of the "Manual of nonwovens" (1971), Textile Trade Press, Manchester, England in association with W.R.C. Publishing Co., Atlanta, U.S.A.

The object of the present invention is furthermore achieved by a tufted nonwoven with improved stitch holding comprising a face material which tufts a bonded nonwoven comprising a mixture of a plurality of bicomponent filaments 1 with a plurality of bicomponent filaments 2 wherein iα) at least bicomponent filaments 1 exhibit a core/sheath geometry wherein component 11 represents the core and component 12 represents the sheath or iβ) at least bicomponent filaments 1 exhibit a side by side geometry wherein component 11 represents side 1 and component 12 represents side 2 or iγ) at least bicomponent filaments 1 exhibit an islands in the sea geometry wherein component 11 represents the islands and component 12 represents the sea ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$, iii) the component 12 exhibits a melting temperature $T_m(12)$, the component 21 exhibits a melting temperature $T_m(21)$ and $T_m(12)$ is higher than $T_m(21)$ and iv) the melting temperatures of both component 11 and 22 and the melting temperatures of components 12 and 21 obey to the relation both $T_m(11)$ and $T_m(22)>T_m(12)>T_m(21)$ and wherein the face material is bonded to bicomponent filaments 1 and 2 by a solidified melt of components 12 and 21.

The tufted nonwoven according to the present invention exhibits excellent stitch holding, because the face material is bonded to bicomponent filaments 1 and 2 by a solidified melt of components 12 and 21 of bicomponent filaments 1 and 2. Furthermore, the tufted nonwoven does not have any problems with respect to delamination because said nonwoven is not a laminate. Finally, the tufted nonwoven exhibits a high degree of kept structural integrity because of the reasons already explained.

Regarding possible embodiments of the face material, bicomponent filaments and their geometries meaning of components 11, 12, 21, and 22 in different bicomponent geometries and general criteria for the selection of materials for said components the same holds true what was still explained during the description of the process according to the invention.

For the sake of conciseness the preferred embodiments of the tufted nonwoven according to the present invention shall be explained in the following in an embodiment according to iα) wherein both bicomponent filaments 1 and 2 exhibit a core/sheath geometry. In this case as explained before the relation of temperatures in iii) reads $T_m(\text{sheath 1})>T_m(\text{sheath 2})$ and in iv) reads both $T_m(\text{core 1})$ and $T_m(\text{core 2})>T_m(\text{sheath 1})>T_m(\text{sheath 2})$.

In a preferred embodiment the tufted nonwoven of the present invention comprises a homogenous mixture of a plurality of bicomponent filaments 1 and 2. This means that in every given volume element of said tufted nonwoven about the same ratio of bicomponent filaments 1 and 2 is realized. Consequently, in every volume element of the tufted nonwoven the face material can be bonded to bicomponent filaments 1 and 2 with the aid of a solidified melt of the sheath of bicomponent filaments 1 and 2.

In a preferred embodiment of the tufted nonwoven according to the present invention bicomponent filaments 1 exhibit a core/sheath geometry wherein component 11 represents the core and component 12 represents the sheath, wherein bicomponent filaments 2 exhibit a core/sheath geometry wherein component 22 represents the core and component 21 represents the sheath and wherein the cores of bicomponent filaments 1 and of bicomponent filaments 2 comprise a thermoplastic polymer selected from the group consisting of polyethyleneterephthalate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

In another preferred embodiment of the tufted nonwoven according to the present invention the sheath of bicomponent filament 1 comprises a thermoplastic polymer selected from the group consisting of polyamide (PA), e.g. PA 6, polypropylene (PP), polyethylene (PE) or copolymers thereof, polybutyleneterephthalate (PBT), polylactic acid (PLA) and aliphatic polyesters.

In still another preferred embodiment of the tufted nonwoven according to the present invention the sheath of bicomponent filament 2 comprises a thermoplastic polymer selected from the group consisting of polypropylene (PP), polyethylene (PE) or copolymers thereof, polylactic acid (PLA) and polyvinylchlorid (PVC).

The selection of bicomponent filaments 1 and 2 for the tufted nonwoven according to the invention results in a combination of bicomponent filaments wherein according to iii) $T_m(\text{sheath 1})$ is higher than $T_m(\text{sheath 2})$. Preferably $T_m(\text{sheath 1})$ is at least 5° C. and most preferably at least 50° C. higher than $T_m(\text{sheath 2})$.

Furthermore, the selection of bicomponent filaments 1 and 2 for the tufted nonwoven according to the invention results in a combination of bicomponent filaments wherein according to iv) both $T_m(\text{core 1})$ and $T_m(\text{core 2})$ are higher than $T_m(\text{sheath 1})$. Preferably $T_m(\text{core 1})$ is at least 20° C. higher than $T_m(\text{sheath 1})$.

In a preferred embodiment of the tufted nonwoven according to the present invention bicomponent filaments 1 comprise a core of polyethyleneterephthalate with $T_m(\text{core})=250°$ C. and a sheath of polyamide 6 with $T_m(\text{sheath 1})=220°$ C.

In an especially preferred embodiment of the tufted nonwoven according to the present invention bicomponent filaments 1 comprise a core of polyethylenterephthalate with $T_m(\text{core})=250°$ C. and a sheath of polyamide 6 with $T_m(\text{sheath 1})=220°$ C. and bicomponent filaments 2 comprise a core of polyethyleneterephthalate with $T_m(\text{core})=250°$ C. and a sheath of polypropylene with $T_m(\text{sheath 2})=160°$ C.

According to the present invention the tufted nonwoven comprises a face material which tufts a bonded nonwoven. Preferably the said face material is selected from the group consisting of polyamide (PA), polypropylene (PP), polylactic acid (PLA), wool and cotton provided that the melting temperature of said polymers and the decomposition temperature of said wool and cotton is higher than $T_m(\text{sheath 1})$.

The object of the present invention is furthermore achieved by a method to manufacture a bonded nonwoven comprising the following steps:

a) Mixing a plurality of bicomponent filaments 1 which comprise a component 11 and a component 12 with a plurality of bicomponent filaments 2 which comprise a component 21 and a component 22 wherein iα) at least bicomponent filaments 1 exhibit a core/sheath geometry wherein component 11 represents the core and component 12 represents the sheath or iβ) at least bicomponent filaments 1 exhibit a side by side geometry wherein component 11 represents side 1 and component 12 represents side 2 or iγ) at least bicomponent filaments 1 exhibit an islands in the sea geometry wherein component 11 represents the island and component 12 represents the sea ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$, iii) the component 12 exhibits a melting temperature $T_m(12)$, the component 21 exhibits a melting temperature $T_m(21)$ and $T_m(12)$ is higher than $T_m(21)$ and iv) the melting temperatures of both component 11 and 22 and the melting temperatures of components 12 and 21 obey to the relation both $T_m(11)$ and $T_m(22)>T_m(12)>T_m(21)$ and producing a basic fibrous layer in a method known per se in which bicomponent filaments 1 contact bicomponent filaments 2 at zones of overlap, and b) heating the basic fibrous layer at a temperature for nonwoven production $T_{np}$ which obeys to the relation $T_m(12)>T_{np}>T_m(21)$ till component 21 melts at the zones of overlap and then cooling below $T_m(21)$ resulting in a bonded nonwoven.

Because of the reasons mentioned before the method to manufacture a bonded nonwoven according to the invention results in a bonded nonwoven of high structural integrity. Within the scope of the present invention heating at $T_{np}$ till component 21 melts at the zones of overlap has the same meaning as explained before.

The bonded nonwoven according to the present invention is a suitable intermediate for the manufacture of the tufted nonwoven with kept structural integrity.

Regarding preferred embodiments of the method to manufacture a bonded nonwoven according to the invention reference is made to what was still preferably claimed and described for steps a) and b) of the method to manufacture a tufted nonwoven.

The object of the present invention is furthermore achieved by a bonded nonwoven comprising a mixture of a plurality of bicomponent filaments 1 with a plurality of bicomponent filaments 2 wherein iα) at least bicomponent filaments 1 exhibit a core/sheath geometry wherein component 11 represents the core and component 12 represents the sheath or iβ) at least bicomponent filaments 1 exhibit a side by side geometry wherein component 11 represents side 1 and component 12 represents side 2 or iγ) at least bicomponent filaments 1 exhibit an islands in the sea geometry wherein component 11 represents the islands and component 12 represents the sea ii) the component 11 exhibits a melting temperature $T_m(11)$, the component 22 exhibits a melting temperature $T_m(22)$ and $T_m(11)$ is equal to $T_m(22)$ or $T_m(11)$ is not equal to $T_m(22)$, iii) the component 12 exhibits a melting temperature $T_m(12)$, the component 21 exhibits a melting temperature $T_m(21)$ and $T_m(12)$ is higher than $T_m(21)$ and iv) the melting temperatures of both component 11 and 22 and the melting temperatures of components 12 and 21 obey to the relation both $T_m(11)$ and $T_m(22)>T_m(12)>T_m(21)$ and wherein bicomponent filaments 2 exhibit zones of overlap at which bicomponent filaments 2 are bonded by component 21.

Each of the constituents of the bonded nonwoven according to the present invention can be chosen independently from one another within the conditions described before. This enables to introduce specifically desired properties into said bonded nonwoven simply by choosing the appropriate components. Consequently the bonded nonwoven exhibits a fine tuned property profile e.g. regarding water uptake, flame retardation etc.

The bonded nonwoven of the present invention does not necessarily exhibit a preferred side (symmetrical structure). Consequently, during further process steps with said bonded nonwoven it is not necessary to take care of which surface is the top side and which surface is the bottom side. If said bonded nonwoven is already to be used as an end product it can be used on both sides.

Because of the reasons mentioned before the bonded nonwoven according to the invention exhibits high structural integrity and is a suitable intermediate for the manufacture of the tufted nonwoven according to the present invention with improved stitch holding and kept structural integrity.

Regarding preferred embodiments of the bonded nonwoven according to the invention reference is made to what was still preferably claimed and described for step a)iα)-a)iv) during the description of the method to manufacture a tufted nonwoven according to the present invention.

The tufted nonwoven of the present invention and the tufted nonwoven which results from the method according to the present invention exhibit a high degree of structural integrity and stitch holding. Therefore, a backing might not be necessary. Nevertheless, if desired the tufted nonwoven of the present invention and/or the tufted nonwoven resulting from the method of the present invention can be provided with one or more backings, e.g. with two backings.

Because of the high degree of structural integrity and stitch holding the tufted nonwoven of the present invention and the tufted nonwoven resulting from the method of the present invention—without or with backing(s)—can be used advantageously to manufacture tufted carpets for home textiles or for cushion vinyl or for decoration or for textiles in automobiles, trains or aircrafts or for out-door applications like synthetic turf or play grounds.

Further on, the tufted nonwoven of the present invention and the tufted nonwoven resulting from the method of the present invention can be used advantageously for carpet molding, for example for car carpets.

It is possible to obtain very fine filament titers by using e.g. the melt-blown technology for mixing bicomponent filaments 1 and 2 during step a) of the method to manufacture a bonded nonwoven according to the present invention by spinning from 3-component spin packs enabling the production of bonded nonwovens with very fine pore sizes, high surface area and—as explained before—with a high degree of structural integrity. Such a bonded nonwoven is highly suitable for bonding in structural, technical and adhesive applications. For example the bonded nonwoven resulting from the method of the present invention and the bonded nonwoven according to the present invention can be used advantageously to manufacture filters for technical applications, e.g. filters against dust, carbon-particulate matter, pollen or gases or to manufacture filters for medical applications, e.g. filter against bacteria or viruses or filters which can be used as heat and moisture exchangers. In the latter application the bonded nonwoven of the present invention and the bonded nonwoven resulting from the method of the present invention captures heat and moisture from a patients breath during exhalation, and cools and releases the trapped moisture for return to the patient during inspiration. Preferred bicomponent filaments 1 and 2 for said heat and moisture exchanging filter combine a low thermal conductivity with a high hydrophilicity at least on the surface, e.g. realized by core/sheath filaments with a polyamide sheath.

Further on, the bonded nonwoven of the present invention and the bonded nonwoven resulting from the method of the present invention can advantageously be used as a coalescent filter to separate a hydrophilic fluid from a hydrophobic fluid, e.g. water from aviation fuel. For said use hydrophilic bicomponent filaments 1 and 2 comprising a hydrophilic surface are needed to allow the hydrophilic fluid to be held and not spread along the filaments.

Further on, the bonded nonwoven of the present invention and the bonded nonwoven resulting from the method of the present invention can advantageously be used to manufacture a wicking product for use as a reservoir in the transfer of ink in marking and writing instruments for medical wicks or for other products which hold and transfer liquids. For said use bicomponent filaments 1 and 2 are needed which exhibit a high surface energy which allows the filaments to wick the desired quantity of liquid. Therefore, bicomponent filaments comprising e.g. polyethylene terephthalate are more suitable for said wicking purposes than bicomponent filaments comprising e.g. polyolefins.

The invention is explained in more detail in the following example:

EXAMPLE

Step a)

For the plurality of bicomponent filaments 1 a yarn is used, consisting of bicomponent filaments which exhibit a core/sheath geometry wherein the core is polyethylenterephthalate (PET) having a melting temperature $T_m(11)=250°$ C. and the sheath is polyamide 6 ($PA_6$) having a melting $T_m(12)=220°$ C. The volume ratio of sheath/core of this yarn is 26 Vol.-%/74 Vol.-%.

For the plurality of bicomponent filaments 2 a yarn is used, consisting of bicomponent filaments which exhibit a core/sheath geometry wherein the core is polyethylenterephthalate (PET) having a melting temperature $T_m(22)=250°$ C. and the sheath is polypropylene (PP) having a melting temperature $T_m(21)=165°$ C. The volume ratio of sheath/core of this yarn is 26 Vol.-%/74 Vol.-%.

Bicomponent filaments 1 and 2 are mixed in a weight ratio of 1:1 and laid onto a conveyor belt in a well known way. A basic fibrous layer is produced having a weight per unit area of 100 g/m$^2$. As a reference a basic fibrous layer is produced from a yarn of bicomponent filaments 2 only, also having a weight per unit area of 100 g/m$^2$.

Step b)

The basic fibrous layer according to the invention is heated in a through-air bonding drum for about 12 seconds and at a temperature for nonwoven production $T_{np}=170°$ C. resulting in a bonded nonwoven according to the invention. The same heating procedure is performed with the reference basic fibrous layer resulting in a comparative bonded nonwoven. While the comparative bonded nonwoven shows a firm hand the bonded nonwoven according to the invention exhibits a soft and hairy appearance.

Step c)

Before tufting both the bonded nonwoven according to the invention and the comparative bonded nonwoven are treated with a commercially available suitable tuft finish in a known way, which provides said nonwovens with about 1-2 wt.-% of said finish. Next, both the bonded nonwoven according to the invention and the comparative bonded nonwoven are loop pile tufted with a polyamide 66 pile yarn (white; turns=220S; type 3252 O; heat set; $T_m=250°$ C.) supplied by Texture-Tex on a tufting machine (1/10" staggered; number of stitches per 10 cm=50). The pile height in the rows is 4 mm. The measurement of the needle penetration force of the comparative bonded nonwoven yields values which can be determined. However, the needle penetration force of the bonded nonwoven according to the invention is practically zero and therefore, cannot be determined.

Step d)

Both the comparative tufted nonwoven and the tufted nonwoven according to the invention are treated in a calender having

- a smooth roller at ambient temperature which roller faces the pile loops and
- an embossed roller having a benzene like print pattern with 5% bonding surface capacity heated at a temperature $T_m=235°$ C. which roller faces the back side of the tufted nonwoven.

Both roller diameters are 120 mm. The samples are treated in nip configuration of the calender. The calender pressure is 3 bar, the speed of the rollers is 3.5 m/min, and the residence time of the tufted nonwovens between said rollers is <<1 second. Table 1 shows values of the stitch holding measured before and after said heat and pressure treatment both of the comparative tufted nonwoven and of the tufted nonwoven according to the invention in the calender. The stitch holding is measured according to Colbond Testmethod 1.1.22 (Mar. 26, 2002) "Stitch holding of carpet samples" as described in the following: A representative sample of about 16×16 cm$^2$ is obtained with a die cutting tool from the tufted nonwoven. From said sample the first center row of pile yarns is removed. Then the next even or odd twenty pile yarn rows are removed. The ends of ten of the remaining pile yarns in machine direction are manually and carefully pulled out of the back side of the tuftet nonwoven. The specimen is fixed in a tentering frame. One end of a pile yarn is fixed in a clamp. The clamp is mounted into the upper clamp of an Instron tensile strength machine provided with a 0-100 N loadcell and has a pulling velocity of 200 mm/min. Then the pile yarn is drawn perpendicularly out of the back side of the tufted nonwoven for a single tuft or for multiple tufts over a distance of 60 mm or minimal three tufts and the force is measured. The maximum force averaged per pile yarn over the number of tuft(s) is the stitch holding value of said single pile yarn. In the same way the stitch holding values of the other nine pile yarns are determined. The mean of the total of maximum forces is defined as the stitch holding of the tufted nonwoven.

Said Colbond stitch holding test method, wherein the pile yarn is pulled out from the back side of the tufted nonwoven, yields lower stitch holding values than ASTM D 1335 (1998), wherein the pile yarn is drawn form the face side of the tufted nonwoven. In the latter case the pile yarn is drawn through the primary backing which results in much higher stitch holding values.

Table 1 shows the results of the stitch holding measurements according to the Colbond test method described above both before and after said pressure and heat treatment (3 bar and 235° C.) of the comparative tufted nonwoven and of the tufted nonwoven according to the invention.

TABLE 1

| Stitch holding of comparative tufted nonwoven (N) | Stitch holding of tufted nonwoven according to the invention (N) |
|---|---|
| before heating: 0.81<br>after heating: 0.91 | before heating: 0.82<br>after heating: 1.02 |

Table 1 shows that before heating under pressure the stitch holding of the tufted nonwoven according to the invention nearly equals the stitch holding of the comparative tufted nonwoven. After heating under pressure the stitch holding of the tufted nonwoven according to the invention is 12% higher than the stitch holding of the comparative tufted nonwoven.

Table 2 shows values of the elongation at break measured according to DIN EN 29073-3 (August 1992) in machine direction MD and in a direction perpendicular to the machine direction CMD of the comparative tufted nonwoven and of the tufted nonwoven according to the invention after said pressure (3 bar) and heat treatment at $T_m$=235° C.

TABLE 2

| Comparative tufted nonwoven MD/CMD | Tufted nonwoven of the invention MD/CMD |
|---|---|
| Elongation at break (%): 94/82 | Elongation at break (%): 106/88 |

Table 2 shows that the elongation at break of the tufted nonwoven according to the invention is higher than that of the comparative tufted nonwoven both in MD and in CMD.

The invention claimed is:

1. A method comprising the following steps:

a) mixing a plurality of bicomponent filaments 1 which comprise a component 11 and a component 12 with a plurality of bicomponent filaments 2 which comprise a component 21 and a component 22 wherein iα) at least bicomponent filaments 1 exhibit a core/sheath geometry wherein component 11 represents the core and component 12 represents the sheath or iβ) at least bicomponent filaments 1 exhibit a side by side geometry wherein component 11 represents side 1 and component 12 represents side 2 or iγ) at least bicomponent filaments 1 exhibit an islands in the sea geometry wherein component 11 represents the islands and component 12 represents the sea, ii) the component 11 exhibits a melting temperature Tm(11) and the component 22 exhibits a melting temperature Tm(22), iii) the component 12 exhibits a melting temperature Tm(12), the component 21 exhibits a melting temperature Tm(21) and Tm(12) is higher than Tm(21), and iv) the melting temperatures of both component 11 and component 22 and the melting temperatures of components 12 and 21 obey to the relation Tm(11) and Tm(22)>Tm(12)>Tm(21), and producing a basic fibrous layer consisting of the bicomponent filaments 1 and the bicomponent filaments 2, in which bicomponent filaments 1 contact bicomponent filaments 2 at zones of overlap, b) heating the basic fibrous layer at a temperature for nonwoven production Tnp, which obeys to the relation Tm(12)>Tnp>Tm(21), until component 21 melts at the zones of overlap and then cooling below Tm(21) resulting in a bonded nonwoven, c) tufting the bonded nonwoven with a face material resulting in a tufted nonwoven, exhibiting contacts between the face material and bicomponent filaments 1 and 2, and d) heating the tufted nonwoven at a temperature Ttn, which obeys to the relation Tm(12)<Ttn<Tm(11) and Tm(22), until component 12 and component 21 melt resulting in a tufted nonwoven in which molten component 21 and molten component 12 contact the face material, and then cooling the nonwoven below Tm(21) to obtain a tufted nonwoven.

2. The method according to claim 1 wherein bicomponent filaments 1 exhibit a core/sheath geometry wherein component 11 represents the core and component 12 represents the sheath, wherein bicomponent filaments 2 exhibit a core/sheath geometry wherein component 22 represents the core and component 21 represents the sheath and wherein the cores of bicomponent filaments 1 and of bicomponent filaments 2 comprise a thermoplastic polymer selected from the group consisting of polyethyleneterephthlate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

3. The method according to claim 1 wherein the sheath of bicomponent filament 1 comprises a thermoplastic polymer selected from the group consisting of polyamide (PA), polypropylene (PP), polyethylene (PE) or copolymers thereof, polybutyleneterephthalate (PBT), polylactic acid (PLA) and aliphatic polyesters.

4. The method according to claim 1 wherein the sheath of bicomponent filaments 2 comprises a thermoplastic polymer selected from the group consisting of polypropylene (PP), polyethylene (PE) or copolymers thereof, polylactic acid (PLA) and polyvinylchloride (PVC).

5. The method according to claim 1 wherein in step a)iii) Tm(12) represents the melting temperature of the sheath of bicomponent filaments 1 Tm(sheath 1), Tm(21) represents the melting temperature of the sheath of bicomponent filaments 2 Tm(sheath 2) and Tm(sheath 1) is at least 5° C. higher than Tm(sheath 2).

6. The method according to claim 1 wherein in step a)iv) Tm(11) represents the melting temperature of the core of bicomponent filaments 1 Tm(core 1), Tm(22) represents the melting temperature of the core of bicomponent filaments 2 Tm(core 2) and both Tm(core 1) and Tm(core 2) are at least 20° C. higher than Tm(sheath 1).

7. The method according to claim 1 wherein bicomponent filaments 1 comprise a core of polyethyleneterephthalate with Tm(core 1)=250° C. and a sheath of polyamide 6 with Tm(sheath 1)=220° C.

8. The method according to claim 7 wherein bicomponent filaments 1 comprise a core of polyethyleneterephthalate with Tm(core 1)=250° C. and a sheath of polyamide 6 with Tm(sheath 1)=220° C. and bicomponent filaments 2 comprise a core of polyethyleneterephthalate with Tm(core 2)=250° C. and a sheath of polypropylene with Tm(sheath 2)=160° C. or 165° C.

9. The method according to claim 1 wherein in step c) a face material is used which is selected from the group consisting of polyamide (PA), polypropylene (PP), polylactic acid (PLA), wool and cotton.

10. The method according to claim 1 wherein the mixing in step a) is performed by assembling or by mixing at a creel or by spinning from 3-component spin packs.

11. A tufted nonwoven comprising a face material which tufts a bonded nonwoven consisting of a mixture of a plurality of bicomponent filaments 1 with a plurality of bicomponent filaments 2 wherein iα) at least bicomponent filaments 1 exhibit a core/sheath geometry wherein component 11 represents the core and component 12 represents the sheath or iβ) at least bicomponent filaments 1 exhibit a side by side geometry wherein component 11 represents side 1 and component 12 represents side 2 or iγ) at least bicomponent filaments 1 exhibit an islands in the sea geometry wherein component 11 represents the islands and component 12 represents the sea, ii) the component 11 exhibits a melting temperature Tm(11) and the component 22 exhibits a melting temperature Tm(22), iii) the component 12 exhibits a melting temperature Tm(12), the component 21 exhibits a melting temperature Tm(21) and Tm(12) is higher than Tm(21), and iv) the melting temperatures of both component 11 and component 22 and the melting temperatures of components 12 and 21 obey to the relation Tm(11) and Tm(22) >Tm(12)>Tm(21), and wherein the face material is bonded to bicomponent filaments 1 and 2 by a solidified melt of components 12 and 21.

12. The tufted nonwoven according to claim 11 wherein bicomponent filaments 1 exhibits a core/sheath geometry wherein component 11 represents the core and component 12 represents the sheath, wherein bicomponent filaments 2 exhibits a core/sheath geometry wherein component 22 represents the core and component 21 represents the sheath and wherein the cores of bicomponent filaments 1 and of bicomponent filaments 2 comprise a thermoplastic polymer selected from the group consisting of polyethyleneterephthalate (PET), polypropylene (PP), polyamide (PA), polybutyleneterephthalate (PBT), polytrimethyleneterephthalate (PTT), polyphenylenesulfide (PPS), polyethylenenaphthalate (PEN), polyethyleneimide (PEI), polylactic acid (PLA) and polyoxymethylene (POM).

13. The tufted nonwoven according to claim 11 wherein the sheath of bicomponent filaments 1 comprises a thermoplastic polymer selected from the group consisting of polyamide (PA), polypropylene (PP), polyethylene (PE) or copolymers thereof, polybutyleneterephthalate (PBT), polylactic acid (PLA) and aliphatic polyesters.

14. The tufted nonwoven according to claim 11 wherein the sheath of bicomponent filaments 2 comprises a thermoplastic polymer selected from the group consisting of polypropylene (PP), polyethylene (PE) or copolymers thereof, polylactic acid (PLA) and polyvinylchloride (PVC).

15. The tufted nonwoven according to claim 11 wherein in iii) Tm(12) represents the melting temperature of the sheath of bicomponent filaments 1 Tm(sheath 1), Tm(21) represents the melting temperature of the sheath of bicomponent filaments 2 Tm(sheath 2) and Tm(sheath 1) is at least 5° C. higher than Tm(sheath 2).

16. The tufted nonwoven according to claim 11 wherein in iv) Tm(11) represents the melting temperature of the core of bicomponent filaments 1 Tm(core 1), Tm(22) represents the melting temperature of the core of bicomponent filaments 2 Tm(core 2) and both Tm(core 1) and Tm(core 2) are at least 20° C. higher than Tm(sheath 1).

17. The tufted nonwoven according to claim 11 wherein bicomponent filaments 1 comprise a core of polyethyleneterephthalate with Tm(core 1)=250° C. and a sheath of polyamide 6 with Tm(sheath 1)=220° C.

18. The tufted nonwoven according to claim 17 wherein bicomponent filaments 1 comprise a core of polyethyleneterephthalate with Tm(core 1)=250° C. and a sheath of polyamide 6 with Tm(sheath 1)=220° C. and bicomponent filaments 2 comprise a core of polyethyleneterephthalate with Tm(core 2)=250° C. and a sheath of polypropylene with Tm(sheath 2)=160° C. or 165° C.

19. The tufted nonwoven according to claim 11 wherein the face material is selected from the group consisting of polyamide (PA), polypropylene (PP), polylactic acid (PLA), wool and cotton.

20. Carpet molding comprising the tufted nonwoven according to claim 11.

21. The tufted nonwoven according to claim 11, in a form selected from the group consisting of home textiles, cushion vinyl, decoration, textiles for automobiles, trains or aircraft, synthetic turf and playgrounds.

22. A tufted nonwoven made by the method of claim 1, in a form selected from the group consisting of home textiles, cushion vinyl, decoration, textiles for automobiles, trains or aircraft, synthetic turf and playgrounds.

23. The tufted nonwoven according to claim 11 wherein a ratio of bicomponent filaments 1 to bicomponent filaments 2 is from 5:95 to 95:5 wt. %.

* * * * *